US007036175B2

(12) United States Patent
Sears et al.

(10) Patent No.: US 7,036,175 B2
(45) Date of Patent: May 2, 2006

(54) WASHING MACHINE WITH PAY ACTIVATED BULK DETERGENT DISPENSER

(75) Inventors: Jeffrey L. Sears, Grinnell, IA (US); Daniel F. Wunderlich, Newton, IA (US)

(73) Assignee: Maytag Corporation, Newton, IA (US)

( * ) Notice: Subject to any disclaimer, the term of this patent is extended or adjusted under 35 U.S.C. 154(b) by 436 days.

(21) Appl. No.: 10/078,647

(22) Filed: Feb. 19, 2002

(65) Prior Publication Data

US 2003/0154557 A1 Aug. 21, 2003

(51) Int. Cl.
*D06F 39/08* (2006.01)

(52) U.S. Cl. ..... 8/158; 68/12.18; 68/17 R; 68/207

(58) Field of Classification Search ..... 8/158, 8/159; 68/12.02, 12.12, 12.18, 13 R, 17 R, 68/207

See application file for complete search history.

(56) References Cited

U.S. PATENT DOCUMENTS

| | | | | | |
|---|---|---|---|---|---|
| 1,609,750 | A | * | 12/1926 | Edwards | 194/244 |
| 1,967,633 | A | * | 7/1934 | Smith | 194/296 |
| 1,968,500 | A | * | 7/1934 | Mills | 194/219 |
| 1,977,781 | A | * | 10/1934 | Staegemann | 222/16 |
| 2,879,143 | A | * | 3/1959 | Thurman | 422/269 |
| 2,972,434 | A | * | 2/1961 | James | 222/66 |
| 3,005,330 | A | * | 10/1961 | Bochan | 68/207 |
| 3,053,417 | A | * | 9/1962 | Box | 222/52 |
| 3,094,247 | A | | 6/1963 | Marchi | |
| 3,101,159 | A | * | 8/1963 | Fletcher | 222/644 |
| 3,120,329 | A | | 2/1964 | Noakes | |
| 3,229,703 | A | * | 1/1966 | Thompson et al. | 134/100.1 |
| 3,277,989 | A | * | 10/1966 | Woroble | 194/288 |
| 3,301,022 | A | | 1/1967 | Low | |
| 3,381,854 | A | * | 5/1968 | Blanchet | 222/2 |
| 3,394,848 | A | * | 7/1968 | McCulloch | 222/56 |
| 3,602,015 | A | * | 8/1971 | Hughes | 68/12.26 |
| 3,881,328 | A | | 5/1975 | Kleimola et al. | |
| 3,982,666 | A | | 9/1976 | Kleimola et al. | |
| 4,188,807 | A | | 2/1980 | Graf et al. | |
| 4,830,509 | A | * | 5/1989 | Gulmatico, Jr. | 366/153.1 |
| 4,862,711 | A | | 9/1989 | Ikeda et al. | |
| 4,875,607 | A | | 10/1989 | Torita et al. | |
| 4,917,272 | A | | 4/1990 | Ikeda | |
| 4,934,563 | A | | 6/1990 | Torita et al. | |
| 4,981,024 | A | | 1/1991 | Beldham | |
| 5,007,254 | A | | 4/1991 | Wolfe et al. | |
| 5,046,336 | A | | 9/1991 | Ferguson et al. | |

(Continued)

FOREIGN PATENT DOCUMENTS

| | | | |
|---|---|---|---|
| BE | 886373 | * | 3/1981 |

(Continued)

OTHER PUBLICATIONS

European Patent Office 0 627 025 Oct. 1997.*

*Primary Examiner*—Frankie L. Stinson
(74) *Attorney, Agent, or Firm*—McKee, Voorhees & Sease, P.L.C.

(57) ABSTRACT

An approved washing machine and method of washing laundry is provided wherein a user can select an amount of an additive, such as detergent, to be automatically supplied from a bulk additive reservoir to the washing machine tub during the appropriate time in the wash cycle. The selected amount of additive corresponds to the amount of payment deposited by the user in the machine. The payment may be made by coin, currency, or debit card.

8 Claims, 1 Drawing Sheet

U.S. PATENT DOCUMENTS

| | | | | | |
|---|---|---|---|---|---|
| 5,088,621 | A | * | 2/1992 | Thompson et al. | 222/1 |
| 5,193,670 | A | * | 3/1993 | Fong | 206/0.81 |
| 5,195,338 | A | | 3/1993 | Russo | |
| 5,208,930 | A | * | 5/1993 | Chabard | 8/158 |
| 5,226,301 | A | | 7/1993 | Rizzzetto et al. | |
| 5,267,676 | A | | 12/1993 | Lord et al. | |
| 5,392,827 | A | * | 2/1995 | Yasso et al. | 141/192 |
| 5,450,938 | A | * | 9/1995 | Rademacher | 194/206 |
| 5,758,521 | A | | 6/1998 | Roberts | |
| 5,870,906 | A | * | 2/1999 | Denisar | 68/17 R |
| 5,957,329 | A | * | 9/1999 | Kenney et al. | 222/1 |
| 6,058,743 | A | | 5/2000 | Fujii et al. | |
| 6,077,427 | A | * | 6/2000 | Burrows | 210/198.1 |
| 6,571,809 | B1 | * | 6/2003 | Cladwell et al. | 134/95.1 |
| 6,578,763 | B1 | * | 6/2003 | Brown | 235/435 |

FOREIGN PATENT DOCUMENTS

| | | | |
|---|---|---|---|
| GB | 2234837 | * | 10/1991 |
| JP | 62-191996 | * | 8/1987 |
| JP | 8-229292 | * | 9/1996 |
| JP | 2001-129300 | * | 5/2001 |

* cited by examiner

WASHING MACHINE WITH PAY ACTIVATED BULK DETERGENT DISPENSER

BACKGROUND OF THE INVENTION

Public laundromats typically use coin operated washing machines wherein a user loads the laundry into the tub, and inserts coins into a coin operated switch to actuate the wash cycle. The user normally must provide his or her own laundry detergent which is added manually to the tub before the machine is started. Users may bring laundry detergent with them to the laundromat, or may purchase detergent at the laundromat. However, this is inconvenient in that the user must remember to bring the detergent or have enough money to purchase the detergent at the laundromat.

Therefore, there is a need to provide washing machines with bulk detergent containers wherein a user may purchase a desired amount of detergent when activating the washing machine.

Accordingly, a primary objective of the present invention is the provision of an improved washing machine having a bulk detergent dispenser which is automatically activated at an appropriate time in the washing cycle of the machine after a monetary payment is made by the user.

Another objective of the present invention is the provision of a method of automatically dispensing detergent from a bulk detergent container in a washing machine after a monetary payment by a user.

Another objective of the present invention is the provision of an improved washing machine wherein a user may make a coin, currency, or debit card payment to select a desired amount of detergent and other additives, such as fabric softener or bleach, which are automatically dispensed during the washing operation.

A further objective of the present invention is the provision of an improved washing machine which eliminates the need for a user to bring his/her own detergent, or to purchase detergent packages at a laudromat.

These and other objectives will become apparent from the following description of the invention.

BRIEF SUMMARY OF THE INVENTION

The improved washing machine of the present invention includes a tub for holding laundry to be washed and a bulk detergent reservoir for holding detergent. A control panel controls the operation of the machine. A monetary payment device is operatively connected to the control panel to sense a monetary payment made by the user to the machine. The payment may be in the form of coins, currency, or a debit card. A pump is operatively connected to the payment means and to the detergent reservoir to automatically pump a selected quantity of detergent from the reservoir to the tub at the appropriate time during the wash cycle of the machine. The selected quantity of detergent corresponds to the amount of the monetary payment.

The method of washing laundry according to the present invention includes the steps of loading laundry into the tub, making a monetary payment to the washing machine corresponding to a selected quantity of detergent to be used during a wash cycle of the machine, starting the machine operation, and automatically transferring the selected quantity of the detergent from the reservoir to the tub during the appropriate wash cycle.

DETAILED DESCRIPTION OF THE INVENTION

Figure 1:
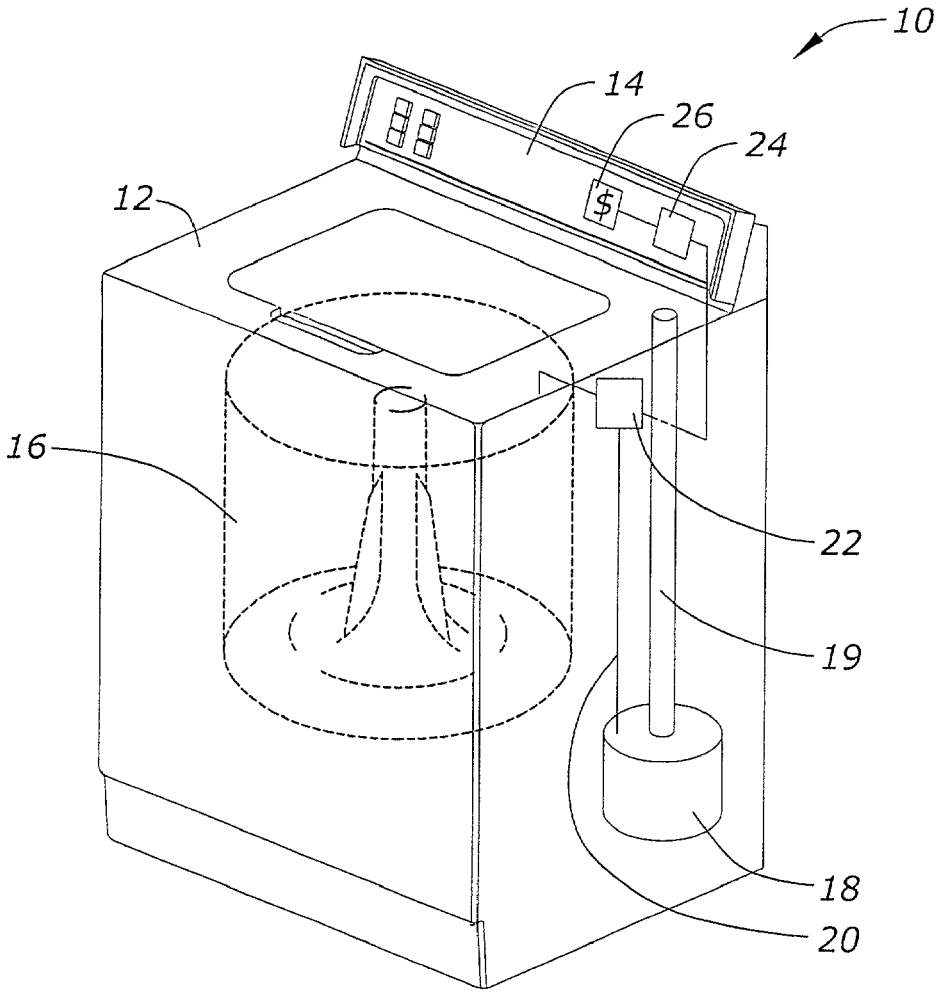
FIG. 1 is a perspective schematic view of a washing machine having a bulk detergent reservoir and a monetary payment device operatively connected to a pump which pumps a selected quantity of detergent from the reservoir in accordance with the amount of the monetary payment.

In FIG. 1, a washing machine is generally designated by the reference numeral 10. The machine 10 includes a cabinet or housing 12, a control panel 14, and a tub 16 rotatably mounted within the housing 12. While FIG. 1 shows the machine 10 to be a top loading machine, it is understood that the present invention, as described below, can also be utilized on a front loading machine.

The machine 10 also includes a bulk detergent reservoir or compartment 18 within the housing 12. A fill tube 19 is provided for easily filling of the reservoir 18. A fluid line 20 provides communication between the detergent reservoir 18 and the tub 16. A pump 22 is disposed in the fluid line 20 so as to transfer detergent from the reservoir 18 to the tub 16 via the fluid line 20.

The pump 22 is operatively connected to the control panel 24, which may include conventional controls for the operation of the washing machine 10. A monetary payment device 26 is also operatively connected to the control panel 24. The payment device 26 includes means for accepting a monetary payment in the form of coins, currency, or a debit card. The payment device 26 also includes a sensor to determine the amount of the payment made by the user. The amount of the payment corresponds to the volume of detergent that is pumped by the pump 22 from the reservoir 18 to the tub 16. Therefore, the user can select a desired amount of detergent to be used during the wash cycle in accordance with the amount of the monetary payment.

In the method of the present invention, the user loads the laundry into the tub 16 of the washing machine 10, and makes a monetary payment to the machine 10 corresponding to a selected quantity of detergent to be used during the wash cycle of the machine 10. The monetary payment may be made before or after the laundry is loaded into the tub 16. The machine 10 is started, and the controls will activate the pump 22 at the appropriate time during the wash cycle, such that the user selected quantity of detergent from the bulk detergent reservoir 18 will be pumped to the tub 16 at the appropriate time during the wash cycle. The selected quantity of detergent corresponds to the amount of the user payment.

Figure 2:
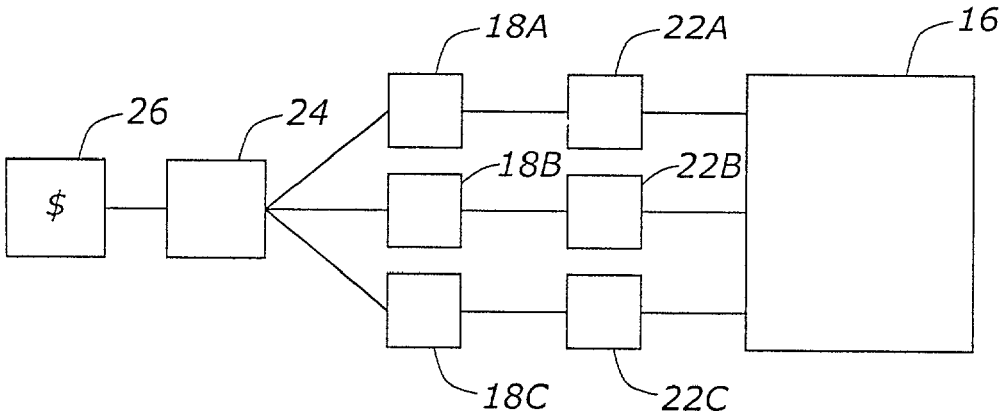
FIG. 2 is a schematic flow chart illustrating the present invention.

FIG. 2 shows another embodiment of the present invention wherein the washing machine 10 includes multiple bulk reservoirs 18A, 18B, 18C, each having a corresponding pump 22A, 22B, and 22C. Each of the reservoirs 18A–18C are for a different laundry additive, such as detergent, fabric softener, and bleach. Alternatively, two of the three reservoirs 18A–18C can be for detergent, with one being used for the prewash cycle and one being used for the wash cycle of the machine 10.

Each of the reservoirs 18A–18C are operatively connected to the control panel 14 and the monetary payment device 26. The control panel 14 allows the user to choose which of the reservoirs 18A–18C the monetary payment is being associated with. The respective pumps 22A–22C will be activated at appropriate times during the operation of the machine 10 to supply the additive from the respective reservoirs 18A–18C to the tub 16, in accordance with the amount of money deposited by the user.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of washing laundry in a washing machine having a rotatable tub and a detergent reservoir containing detergent, the method comprising:

loading laundry into the tub;

making a monetary payment to the machine corresponding to a selected quantity of detergent to be used during a wash cycle of the machine;

staffing the machine operation;

automatically transferring the selected quantity of detergent from the reservoir to the tub during the wash cycle of the machine.

2. The method of claim 1 wherein the payment is made with coins or currency.

3. The method of claim 1 wherein the payment is made with a debit card.

4. The method of claim 1 wherein the selected quantity of detergent is less than the volume of the reservoir.

5. The method of claim 1 wherein the detergent is transferred to the tub by pumping.

6. The method of claim 1 further comprising making a second monetary payment to the machine corresponding to a selected quantity of a laundry additive to be used during the operation of the machine.

7. The method of claim 6 wherein the additive is fabric softener.

8. The method of claim 6 wherein the additive is bleach.

* * * * *